US010421243B2

(12) United States Patent
Williams

(10) Patent No.: US 10,421,243 B2
(45) Date of Patent: Sep. 24, 2019

(54) METHOD AND DELIVERY OF COMPACTING MATERIALS

(71) Applicant: Richard T. Williams, Lewis Center, OH (US)

(72) Inventor: Richard T. Williams, Lewis Center, OH (US)

(73) Assignee: Richard T. Williams, Lewis Center, OH (US)

( * ) Notice: Subject to any disclaimer, the term of this patent is extended or adjusted under 35 U.S.C. 154(b) by 1256 days.

(21) Appl. No.: 13/969,357

(22) Filed: Aug. 16, 2013

(65) Prior Publication Data

US 2015/0047516 A1 Feb. 19, 2015

(51) Int. Cl.

| | |
|---|---|
| ***B30B 1/32*** | (2006.01) |
| ***B65F 3/20*** | (2006.01) |
| ***B30B 9/30*** | (2006.01) |
| ***B65F 3/00*** | (2006.01) |
| *B65F 3/02* | (2006.01) |

(52) U.S. Cl.

CPC ..... *B30B 1/32* (2013.01); *B30B 9/3021* (2013.01); *B30B 9/3032* (2013.01); *B30B 9/3046* (2013.01); *B30B 9/3057* (2013.01); *B65F 3/001* (2013.01); *B65F 3/201* (2013.01); *B65F 3/207* (2013.01); *B65F 2003/0279* (2013.01)

(58) Field of Classification Search

CPC ... B30B 9/3021; B30B 9/3032; B30B 9/3057; B30B 9/3046; B30B 9/3082; B30B 9/3014; B30B 1/32; B65F 3/207; B65F 3/26; B65F 3/201; B65F 2003/0279; B65F 1/004; B65F 3/001; B65F 3/24; B65F 3/046; B65F 3/08; B65F 3/045

USPC ..... 100/100, 233, 240, 241, 245, 251, 250; 414/469, 525.51, 525.52, 525.5, 409

See application file for complete search history.

(56) References Cited

U.S. PATENT DOCUMENTS

| | | | | | |
|---|---|---|---|---|---|
| 2,084,656 | A * | 6/1937 | Rottee | B65F 3/08 | 414/501 |
| 3,195,448 | A * | 7/1965 | Larsen | B30B 9/30 | 100/229 A |
| 3,232,463 | A * | 2/1966 | Weir | B65F 3/205 | 414/493 |
| 3,709,389 | A * | 1/1973 | Steltz | B30B 9/3046 | 100/229 A |
| 3,802,585 | A * | 4/1974 | Churchman | B65F 3/28 | 414/512 |
| 3,880,072 | A * | 4/1975 | Ord | B30B 9/3042 | 100/100 |

(Continued)

FOREIGN PATENT DOCUMENTS

| | | | | |
|---|---|---|---|---|
| DE | 3244216 A1 * | 6/1983 | ..... | B30B 9/3046 |
| FR | 2757443 A1 * | 6/1998 | ..... | B30B 9/3014 |
| GB | 2110591 A * | 6/1983 | ..... | B30B 9/3046 |

*Primary Examiner* — Jimmy T Nguyen

(74) *Attorney, Agent, or Firm* — Dickinson Wright PLLC

(57) ABSTRACT

A method and system for compacting waste materials in a collection container. The container can be a freestanding waste container, a self-container compaction container, or a container on a waste collection vehicle. A hydraulically operated compactor blade is positioned in the raised upper portion of the container with its bottom edge a distance above the floor. A platform with a hinged portion can be included to divide the container volume into two separate compartments in order to collect different types of waste materials.

45 Claims, 6 Drawing Sheets

(56) References Cited

U.S. PATENT DOCUMENTS

| | | | | | |
|---|---|---|---|---|---|
| 4,221,527 | A * | 9/1980 | Morrison | B65F 3/28 | 414/517 |
| 4,576,540 | A * | 3/1986 | Derain | B65F 3/28 | 100/295 |
| 5,029,522 | A * | 7/1991 | Brisson | B30B 9/3014 | 100/218 |
| 5,076,159 | A * | 12/1991 | Vedeo | B30B 9/3046 | 100/233 |
| 5,316,430 | A * | 5/1994 | Horning | B65F 3/001 | 298/24 |
| 5,427,496 | A * | 6/1995 | Ratledge, Jr. | B65F 3/001 | 100/208 |
| 5,716,103 | A * | 2/1998 | Kann | B65F 1/004 | 298/1 B |
| 5,868,543 | A * | 2/1999 | McNeilus | B65F 3/201 | 414/512 |
| 5,885,049 | A * | 3/1999 | McNeilus | B65F 3/001 | 414/512 |
| 2012/0171008 | A1* | 7/2012 | Billing | B65B 5/06 | 414/800 |

* cited by examiner

METHOD AND DELIVERY OF COMPACTING MATERIALS

TECHNICAL FIELD

The present invention relates to material compacting, and more particularly to industrial waste compactor systems and waste collection vehicles.

BACKGROUND

Methods and devices for picking up, storing and disposing of waste materials are in common use today. The devices include compactors with receiver containers, self-contained compactors and waste vehicles, among other devices and systems.

Stationary compactor systems typically include a compactor device and one or more large metal box-like containers. The containers are put in a location adjacent the compactor device when empty, and then picked up when loaded. The loaded containers are then taken to a landfill or dump site and unloaded. At a site where containers are required continuously, empty containers are typically dropped off when the loaded containers are picked up. The containers typically have wheels or slide rails on the bottom so they can be more easily moved into position and loaded and unloaded on a vehicle.

Trash and other waste materials are loaded into the containers typically at a door at the end or an opening in the top surface. A hydraulically operated pusher blade in the compactor device can be used to compact materials in some systems. Once compacted, the blade is returned to its rest position so additional materials can be loaded. Once the container is fully loaded, it is picked up (typically by a truck with a bed) and usually replaced with an empty container.

Waste collection vehicles (commonly called "garbage trucks") have a large storage container on the back of the vehicle behind the cab and typically are made in two basic styles: a rear loading style, and a front loading style. The rear loading style has an opening in the lower portion at the rear of the truck where the trash can be loaded. Once a portion of the trash or waste is loaded, a hydraulically actuated blade member is used to transfer the trash toward the front of the container. A second hydraulically actuated blade member is then used to compact the trash inside the container. The front loading style has an opening in the top of the container behind the cab and uses hydraulic-actuated arms to pick up loaded dumpsters or waste containers and dump them into the opening. The waste materials are then compacted by a hydraulically operated blade member inside the container. Once loaded, both styles of waste trucks are driven to a landfill or other location where the loads are dumped out or ejected. Once empty, the trucks are available to pick up more trash and repeat the process.

Both of these types of compactors, i.e. the waste compactor systems and the waste collection vehicles, have concerns that need improvement. The forces necessary to adequately compact the trash and waste materials require heavy and strong metal structures, which are expensive and add to the total weight of the load. Collection containers and vehicles constructed of lighter and weaker materials would require additional expense and maintenance to prevent premature failure. Also, the present systems often require manual cleaning to remove loose materials, particularly those which become lodged behind the compaction blades.

In addition, the present collection containers, either freestanding or on waste collection vehicles, are inefficient in that they often leave significant voids and open areas in the compacted loads. Also, the compacted materials typically "fall-back" causing de-densification during blade retraction. The incomplete filling causes unnecessary trips for unloading over a given period of time. Further, the present collection members typically are not water tight and allow liquids in the waste materials to leak out. This also causes messy and time consuming clean ups.

There is a need in the waste collection field for compactor systems and compactor vehicles which are more efficient and can fill a larger percentage of the volume inside the containers. There further is a need for compactors which are more energy efficient and which do not cause premature wear on the container or components.

SUMMARY OF THE INVENTION

The present invention has particular use, but is not to be limited to, freestanding waste collection systems and front-loading waste collection vehicles. The inventive system utilizes a single compactor blade member which is located at an elevated (raised) position above the floor of the waste containers. The blade member is hydraulically operated and preferably guided by guide rails positioned on the sidewalls or upper walls of the containers.

As waste materials are introduced into the waste container through a door or opening in the ceiling or upper walls, the compactor blade is activated which levels out the materials in the container, and can compact a portion of the materials against the opposite end of the container. The heavier or more dense waste materials settle at the bottom portions of the collection container, while the lighter and less dense materials are pushed longitudinally along the existing filled volume of waste materials in the lower level of the container. As the volume of the container is filled, more and more of the materials will be compacted against the opposite end and vertically downwardly. Some of the waste material can also be pulled back in the retraction direction of the compactor blade in order to fill any open spaces. The compactor blade can be hydraulically operated in either a push or pull-type hydraulic system.

One embodiment of the present invention has two compartments in the container in order to collect different types of waste materials. This embodiment has particular use in collecting normal waste or trash materials in one compartment, and collecting recyclables in the other compartment. A platform or shelf is located below the container entry opening and the materials can be pushed or pulled one way or the other, into the first or the second compartments, depending on the type of materials being introduced into the container. The platform also can have a hinged or moveable portion so that the two compartments can be separately emptied. Alternately, removal openings or doors can be provided at each end of the container.

Further features and benefits of the invention will become apparent from a review of the following detailed description, together with the accompanying drawings and appended claims.

DESCRIPTION OF THE PREFERRED EMBODIMENTS

The present invention will be described herein with respect to uses relative to waste collection containers and front-loading waste collection vehicles. It is to be understood, however, that the present invention can be used on other containers and other vehicles, and for purposes other than waste collection and disposal. In this regard, the invention can be used, and has utility and benefits for use, with any structures, equipment, and vehicles falling within the scope of the claims.

Another preferred use of the invention relates to collection and disposal of organic materials, such as brush, leaves and moist garbage. The invention also can be used effectively, and with more advantages and benefits over the prior art, with respect to collection and disposal of these materials, or with other waste materials that contain a high percentage of liquids.

In the attached drawings, FIGS. 1-7 depict various embodiments of the invention for use with freestanding or stationary waste compaction systems. FIGS. 8-11 depict various embodiments of the invention when used on, or with, front loading waste collection vehicles (often called "garbage trucks").

The term "waste materials" and "trash materials" will be used synonymously herein. These terms also are to be interpreted in their broadest sense and encompass all types of materials that are intended to be discarded and/or disposed of. Waste and trash materials, for example, include, but are not limited to, paper materials, wood materials, cardboard materials, glass items or materials, plastic items or materials, metal items or materials, organic materials, lawn and forest materials, and the like. The materials also can be dry or have a significant fluid content.

Figure 1:
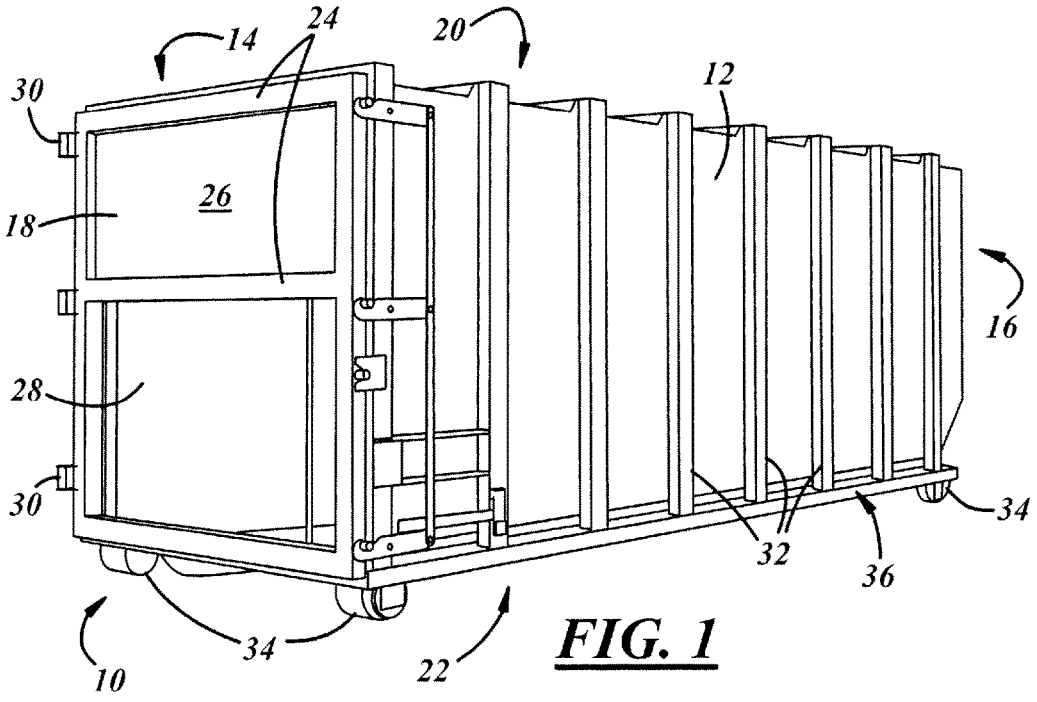
FIG. 1 depicts a freestanding waste container.

FIG. 1 depicts a waste compaction container 10. This container is meant to be representative of all of the various types, sizes, and styles of waste compaction containers (some called "closed top boxes") that either are in existence at the present time, or may come into existence in the future.

The container 10 is used to hold waste materials. The container has two sidewalls 12 and 14, two end walls 16 and 18, a top wall 20 and a bottom wall 22. The container 10 is preferably made of a strong and durable metal material, such as steel. As shown in FIG. 1, the container has a hinged door member 30 on the rear end wall 18. The door has a frame member 24 that is the same size as the end wall opening. The frame member has a solid upper portion 26 and lower portion 28 which is open to allow entry of waste material. The door member 18 is hinged at one side by hinge members 30 so the entire end wall can be opened for emptying or dumping of the collected waste materials inside the container 10.

Some embodiments of the container 10 also can have an opening (not shown in FIG. 1, but shown in FIGS. 2-6) in the upper wall 20. The opening can be used in some instances to introduce waste materials into the container and typically has a door or cover member (not shown) to selectively close or cover the opening and thus lower portion 28 as shown in FIG. 1 is solid. Also, the container 10 has a plurality of reinforcement members 32 on at least the side walls 12, 14 to add strength and durability.

Further, a plurality of wheels 34 or skid members (not shown) are positioned on the bottom corners of the container 10, as well as a pair of side rails 36. These allow the container 10 to be more easily loaded and unloaded from a delivery vehicle. In this regard, empty containers are dropped off at the collection site and then picked up and emptied when they are full. The contents are typically emptied at a landfill or other dump site.

Waste collection containers, such as representative container 10, are typically utilized with a stationary compactor mechanism or device (not shown). The compactor mechanism receives waste and trash materials and typically compacts them and pushes them into the container through the opening in the lower portion 28 of the frame member 24 in door member 18. In some instances, as discussed in more detail below, the compactor mechanism is positioned interiorly or exteriorly to a building and receives the waste materials from a chute. Some compactor mechanisms also can pre-crush the materials in the compactor chamber as a first step and then push the crushed material into a container.

The present invention provides a waste container which incorporates its own compaction system. The compaction system is preferably hydraulically operated and includes a compactor blade which is positioned and reciprocates in the upper areas of the containers above the floor. For shorthand purposes of the present description of the invention, the waste collection container in accordance with the present invention will be simply called by the term "waste container" herein.

Figure 2:
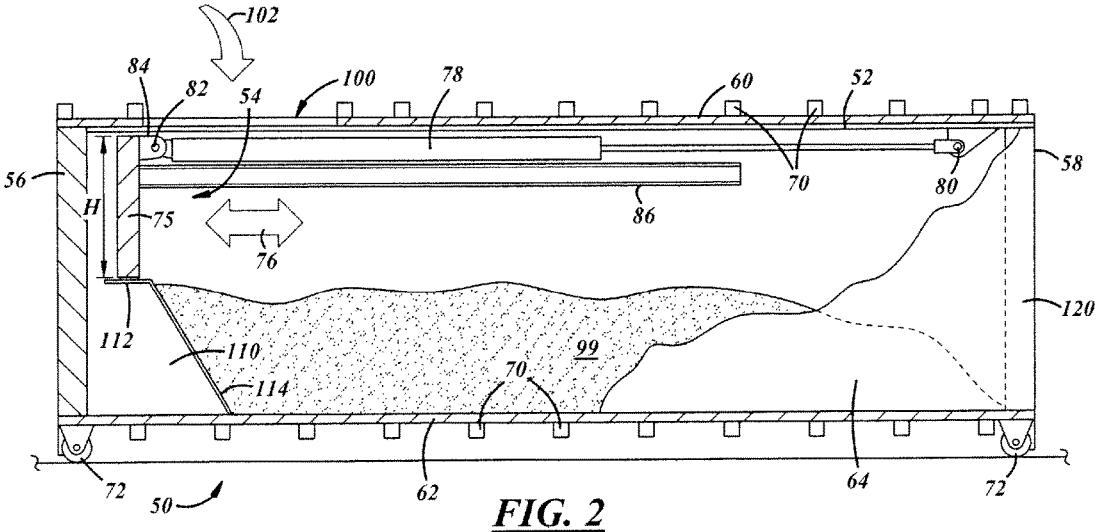
FIG. 2 depicts a preferred embodiment of the invention.

One preferred embodiment of the invention is depicted in FIG. 2. It is generally designed by the reference number 50 and includes a box-type container 52 and a compactor mechanism 54. The container structure itself is similar in many respects to the one described above with reference to FIG. 1. The container 52 has a front wall 56, a rear wall 58, an upper wall 60, a lower wall 62, and a pair of side walls 64 and 66 (not shown). The container 52 is made from strong metal material, such as steel, and includes a plurality of reinforcing members 70 and a plurality of wheels 72.

A compactor blade 75 which is hydraulically operated, can reciprocate back and forth substantially along the length of the container—as shown by arrow 76. A pair of hydraulic cylinder members 78 are provided (only one of which is shown in FIG. 2) to move the blade 75 in the container. In the embodiment shown in FIG. 2, the blade 75 is pulled in the container in order to distribute and compact waste materials. An alternate hydraulic system could be provided which could push the blade in the container to achieve the same purpose. The hydraulic cylinders are attached at one end 80 to the container and at the other end 82 to the compactor blade or vice versa. A pair of brackets 84 is provided on the blade for this purpose.

Figure 3A:
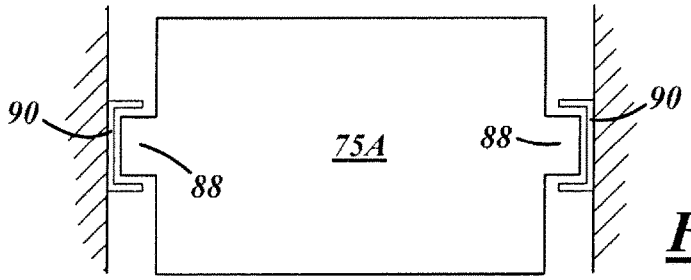
FIGS. 3A and 3B depict alternate embodiments for guiding a compactor blade in a container.
Figure 3B:
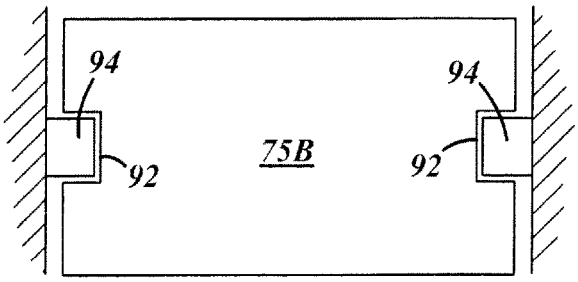

The blade is preferably made of a metal material and can be a solid structure or a thinner structure backed by supporting reinforcing members. The blade 75 is preferably guided along the length of the container by channels 86 or guide members. In this regard, two alternative exemplary ways to guide the movement of the blade in the container are shown in FIGS. 3A and 3B. In FIG. 3A, the blade 75A has two projections 88 which are guided in U-channels 90 at the sidewalls of the container. In FIG. 3B, the blade 75B has grooves 92 on its side edges which are positioned between and guided by guide rail member 94 on the side walls of the container. There are numerous other ways for the compactor blade to be guided along the length of the container, such as, for example, guide rails or channels on the top wall. With any of the guiding systems, it is preferred that a clearance of about 0.5"-1.0" is maintained between the compactor blade and the walls of the container. More clearance can be needed if the container walls are tapered. In the preferred embodiment, the interaction of the guide rails and mating compaction blade guide means allow the blade to "float" between the guide rails as it travels back and forth on the inside of the container.

The raised compactor blade can alternatively be attached to a carriage which guides the blade along the length of its stroke in the container. The carriage can be designed to distribute the large twisting and movement loads into guide channels or guide rails.

The container 52 has an opening 100 on the top wall 60. The trash and waste materials are inserted into the hollow volume inside the container through the opening 100. This is shown by arrow 102. A cover member (not shown) can be provided to cover the opening.

The hydraulic mechanism used to actuate the compactor blade 75 can be positioned at any location inside or outside the container 52. In the embodiment shown in FIG. 2, hydraulic operating mechanism is located in compartment 110 at the front of the container. The compartment has an upper surface 112 adjacent the lower edge of the compactor blade 75 and a front wall 114. The front wall 114 can be slanted as shown in FIG. 2.

When the trash and other waste materials are introduced into the container 52, the compactor blade 75 is activated and is used to push the materials toward the rear wall 58 of the container. The heavier and more dense materials will fall by gravity toward the bottom wall or floor of the container and the blade will level out the materials along the container. The movement of the blade also can compact the material below the blade by pressure from other materials. Any materials which remain above the lower edge of the blade can be compacted against the rear wall of the container. The blade also can level out or help compact the lower level materials when the blade is being retracted to its start (rest) position. Movement of the compactor blade back and forth several times along its length of trash assists in redistributing and densifying the waste materials.

When the container 52 is full, it is transported to a dumpsite or land fill and dumped, ejected or otherwise unloaded in a similar manner as set forth above with reference to FIG. 1. A hinged door member 120 is provided at the rear wall 58 for this purpose.

The compactor blade 75 is located at its rest position at the front end of the container. The power unit which operates the blade includes an electric motor, hydraulic pump and hydraulic fluid reservoir, and is a self-contained system. A water tight seal is provided around the compartment 110 to prevent wet or semi-liquid waste materials from affecting the operation of the power unit.

The specific type of hydraulic mechanism utilized to reciprocate the compactor blade and level and compact the waste materials in the container is not critical. Most of the known hydraulic mechanisms in use today for the stationary waste compactors could be utilized. In addition, the hydraulic cylinders could be positioned behind the compactor blade and include a "scissor"-type mechanism.

As the material in the container increases in volume, the more the materials will settle and migrate downwardly, and become compacted in the area below the lower edge of the compactor blade. Any materials which stick up after the blade passes will be leveled or compacted as the blade travels in the opposite direction, or back-and-forth several times.

With the present invention, the amount of material that can be compacted and loaded inside the container is more than the amount that can be loaded and compacted into collection containers known today. Due to the top loading and raised compaction blade, the trash materials act in a manner more like fluid dynamics in filling the container volume to a greater extent. The amount of voids and open areas are decreased with the invention. Redistribution of materials of different densities can be achieved by continued movement of the raised blade. Also, the amount of "fall back" of the materials in the container that are compressed is less than with known compaction systems. This means that there is less "de-densifying" of the materials in a collection container with use of the present invention. It is believed that the use of a raised floor at one end of the container, such as wall 114 of compartment 110 in FIG. 2, may assist in preventing such "de-densifying." Wall 114 may be vertical or at an angle nearly vertical as shown in FIG. 2.

As indicated, the compactor blade 75 is positioned only in the upper or raised elevations or areas of the space in the container 52. The blade 75 has a height H at its lower edge which is 30-70% of the height of the inside of the container as measured form the top wall 60 toward the bottom wall 62. This means that the lower edge of the blade is preferably distanced from the bottom wall an amount 30%-70% of the total height inside the container. Preferably, the lower edge is at a height H less than 50% of the overall height of the container. The height H of the blade can also be changed depending on the waste materials that are to be loaded into the container. Typically, the heavier and more dense are the waste materials, the less is the distance H. Similarly, with lighter and less dense materials, the distance H can increase.

The compactor blade 75 can be actuated by any conventional hydraulic compactor mechanism or system so long as it can move the blade along at least a portion of the container and compact waste materials against the rear wall. In some embodiments, it may be necessary to only have the raised blade travel about one-half the length of the container. Other embodiments may require the blade to travel substantially the entire length of the container. One or more hydraulic mechanisms or cylinders can be used to either push or pull the compactor blade longitudinally inside the container. In FIG. 2, the waste materials are indicated generally by the numeral 99.

It is understood that the travel of the blade inside the container can be for any portion of the length of the container from 0%-100%. The length of travel depends in part on the type of waste materials being collected. In most instances, the length of travel of the blade can be 25%-75% of the length of the container, and preferably 30%-70%.

In general, the guide rail members can have slots or tracks in them and the blade member can have corresponding fingers, appendages, protrusions, or the like which fit and slide in or on the slots or tracks. In other embodiments, the sets of two guide rails can be spaced a certain distance apart, such as 6"-12", and the side edges of the compactor blade can have a protrusion or raised member which fits between the pair of guide rails (as shown in FIG. 3A). The distance between the guide rail members can allow the blade members to float between them and thereby be prevented from sticking or jamming. If the inside surfaces of the side walls are tapered, as with some of the containers today, additional clearance will need to be maintained between the blade and the side walls. The side edges of the blade also can be angled corresponding to the angle of the sidewalls.

Figure 4:
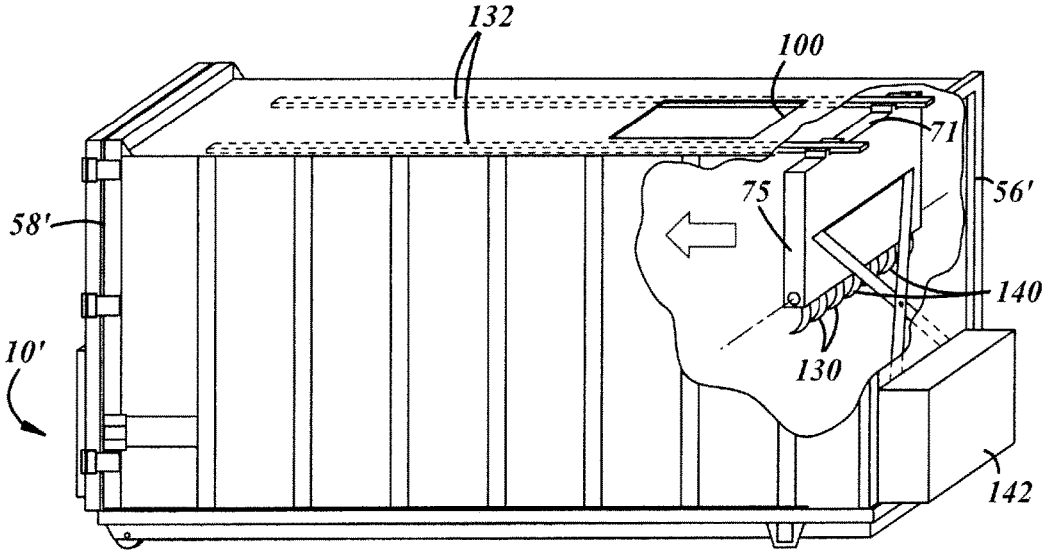
FIGS. 4 and 5 illustrate alternate embodiments of the invention.

In an additional embodiment, a plurality of rotatable claw members 130 (or finger members) can be positioned extending downwardly on the lower edge of the compactor blade 75'. This is shown in FIG. 4. In use, the claw members 130 assist in moving and spreading waste materials as the blade moves in a direction toward the rear end 58' of the container 10'. When the blade is returned to its rest position and moving in the opposite direction, the claw members rotate upward toward the front of the blade and thus pass easily over the waste materials in that direction. As an alternative to claw members, a panel member can be provided pivotable or rotatably secured to the bottom edge of the compactor blade. The panel member is fixedly secured in position as the blade moves in its primary direction, but can pivot and be loosely held in position on the return stroke of the blade. The panel blade can provide a downward compaction force on the waste materials as the blade progresses.

FIG. 4 also depicts an embodiment of the invention in which guide rails 132 for guiding the blade 75 are positioned on the inside of the top wall member 60. In addition, the optional use of a "scissor"-type hydraulic mechanism 140 to move the blade 75 in the container 10' is depicted in FIG. 4. The power unit and mechanism for operating the hydraulic mechanism is positioned at 142 at the front end 56' of the container, which is preferable, but not mandatory. In this FIG. 4, the "scissor-"type mechanism is shown schematically. In actual use, the scissor action will extend and collapse along the axis of the compactor blade.

As indicated above, the heavier and more dense waste materials will fall or gravitate due to their weight or structure into the lower levels of the waste materials. The lighter and less dense materials will typically stay on top. Thus, with many of the strokes of the compactor blade, the principal materials that will be compressed either against the front wall or against the earlier compacted waste materials, are the lighter and less dense materials. This means that such strokes will result in less "wear and tear" on the floor of the container, as well as on the blade and hydraulic system. This would also use less energy. This also means that voids and open spaces in the trash materials are more likely to be filled in.

As the compactor blade returns to its rest position adjacent the end wall of the container, any materials which are still higher than the bottom edge of the blade, or which "pop up" after the blade passes them, will be leveled or pushed into the space against the end wall.

With the present invention, that the fill volume in the container will be greater than with compaction systems or mechanisms which utilize short compaction blades positioned on the floor of the containers, or with full height compaction blades that extend from the floor to the ceiling. Also, the amount of voids or free space left unfilled in the container appears to be full and needs to be emptied will be less with the present invention.

Figure 5:
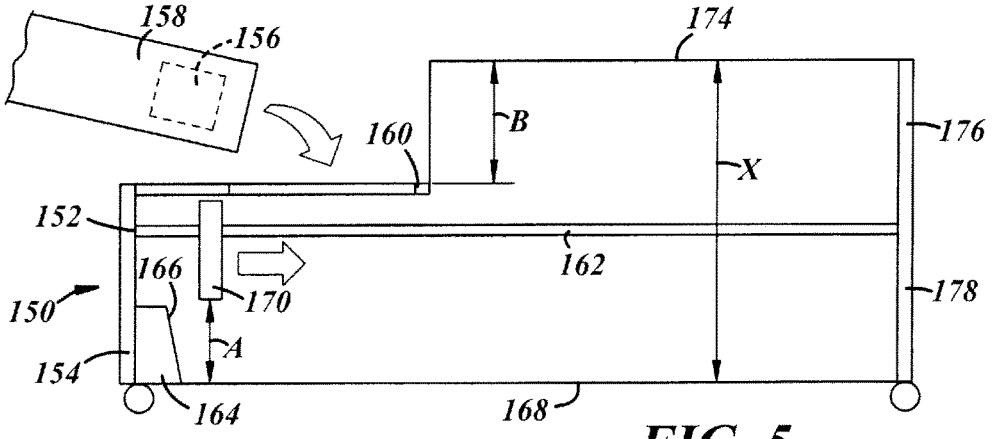

An alternate embodiment of the invention is disclosed in FIG. 5 and referred to generally by the reference numeral 150. The container 152 has a lowered front end wall 154 and is used to collect trash and other waste materials 156 which are supplied from above, such as by a chute member 158 attached to a building or other structure (not shown). Waste chutes of this type are in common use today. With these known systems, a compactor mechanism is typically positioned below the end of the chute. The compactor mechanism slides the waste materials into the collection container. Compaction occurs when there is no space in front of the compaction blade.

With the embodiment of the invention depicted in FIG. 5, the use of a stationary compactor mechanism is unnecessary. The chute 158 can drop the waste materials 156 directly into the container 152. An opening 160 is provided for this purpose. A compactor blade member 170 is provided inside the container 152 and guided by, for example, a plurality of guide rails 162. The blade member 170 is operated by a hydraulic power unit 164 positioned in compartment 166 inside the container. The power unit can also be positioned at other locations on or off the containers. For example, the type, contents and position of the hydraulic power unit and hydraulic mechanism used to operate the compactor blade can be any of the embodiments set forth herein or any other type known in the art.

The size of the opening 160 can depend in part on the size of the waste materials being compacted. Typically the openings extend substantially across the width of the container, and extend in the longitudinal direction of the container. The present invention opening can be considerably larger in both width and length dimensions. The width may be 70" wide versus 60" and the length not limited to the catalog sizes of conventional compactors of 42" and 60", but only limited to one-half the travel of the waste container length. The nominal length of a waste collection container is 22 feet.

As shown in FIG. 5, the compactor blade 170 is positioned a distance "A" above the bottom floor 168 of the container. Also, due to the lowered front end of the container 152, the blade is also positioned a distance "B" from the upper wall 174 of the container. A door member 176 for emptying the container is provided at the rear wall 178 of the container.

The distances "A" and "B" are dependent on the size of the container and the amount that the front end of the container has been lowered to be able to receive waste materials from a chute member or the like. In general, the distance "A" should be 30-50% of "X", which is the height of the container at the opposite end. Also, the distance "B" should be about 20-30% of the height "X".

Figure 6A:
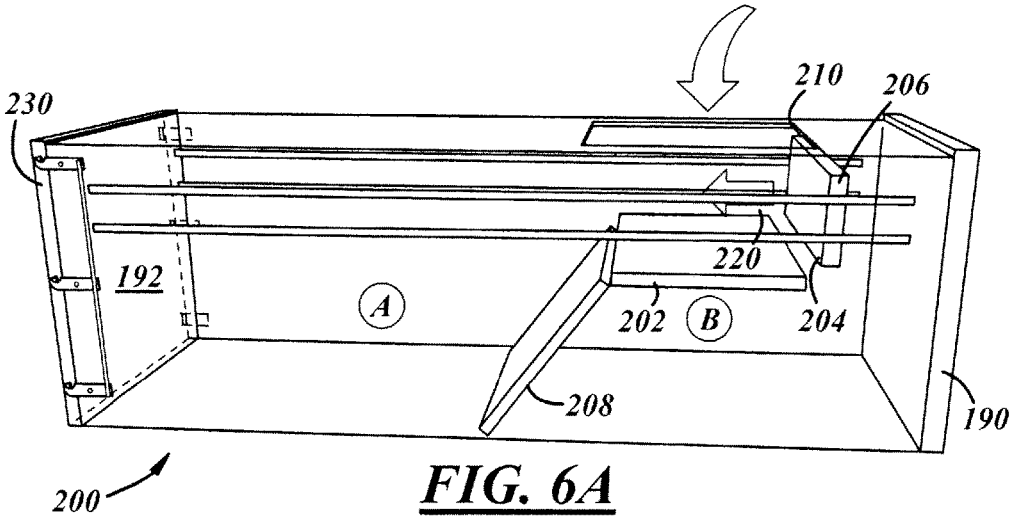
FIGS. 6A and 6B schematically depict a two-compartment embodiment of the invention.
Figure 6B:
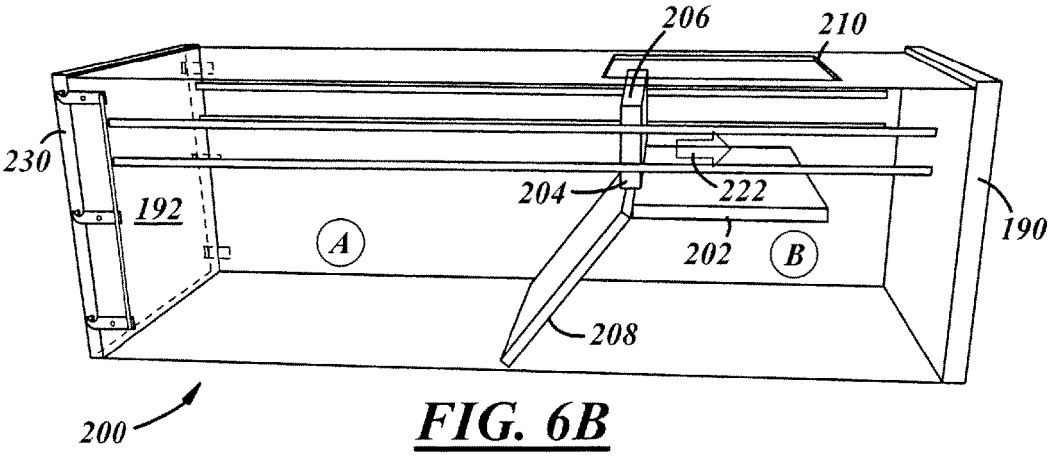

It is also possible with another embodiment of the invention to provide two separate areas A and B in a container 190. This is shown in FIGS. 6A and 6B. In this embodiment 200, a platform or shelf member 202 is positioned in the container at a height adjacent the lower edge 204 of the compactor blade member 206. The platform 202 is preferably located under opening 210. The platform 202 rear edge has a hinged portion 208 which in the lowered position shown in FIG. 6A divides the space inside in the container into two separate areas A and B. In an alternate embodiment, the forward edge could terminate about half the length of the opening 210 allowing material to free fall into area B (illustrated in FIG. 7).

With this embodiment of the invention, the waste collection container can be used to collect two different types of waste materials, such as organic material on one side and metal or plastic materials on the other side, or as waste materials on one side and recyclable materials on the other side.

This saves use of two separate vehicles traveling along the same route in order to pick up separate materials and also saves the expense and foot print of the two waste containers.

In order to direct the waste materials into area A, the compactor blade 206 is used in the standard manner as discussed above. The materials are introduced into the opening 210 in FIG. 6A and pushed into area A by movement of the blade member 206 in the direction of arrow 220. Then, when it is desired to introduce materials into area B, the blade member 206 is first moved to the position shown in FIG. 6B. Then, when the second type of materials is introduced into the container through opening 210, the blade member is moved in the direction of arrow 222 to push the materials into area B. It is also possible to position the compactor blade mid-way in the opening so that different types of materials can be separately introduced (typically manually) into areas A and B without having to move the blades, as frequently.

When it is desired to empty the container 190, a hinged door member 230 is provided at the rear end wall 192 for this purpose. After the materials in portion A are emptied, then the hinged shelf portion 208 is raised and the materials in portion B can be emptied out of the same door member. In this regard, the typical manner in which waste collection containers are emptied is to raise one end of the container and let the materials fall out the door at the other end. The activation of the compactor blade can assist in ejecting or removing the materials from the container.

In another embodiment, separate door members can be provided at each end of the container in order to allow the collected materials to be removed separately.

Figure 7:
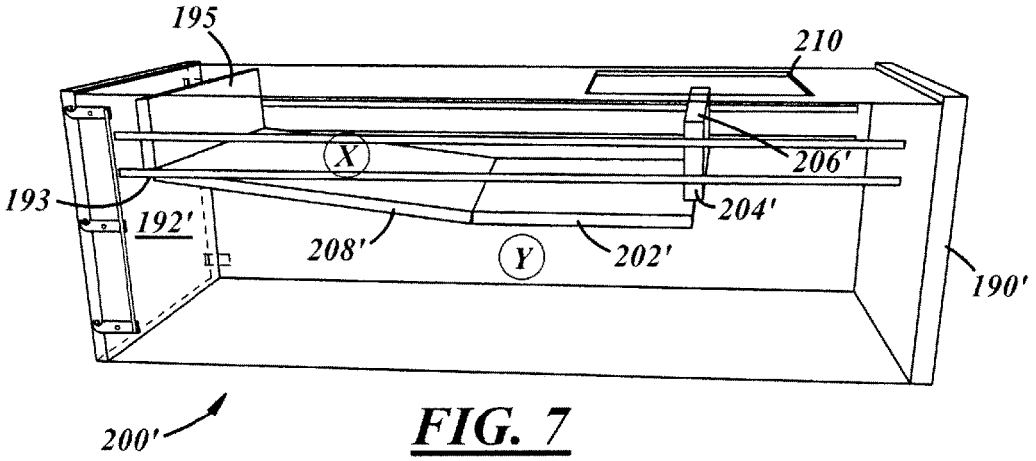
FIG. 7 illustrates another embodiment of the invention.

FIG. 7 illustrates a modification of FIGS. 6A-6B. In FIG. 7, the portion 208' of the interior platform is angled upwardly toward the end adjacent the rear wall 192' of the container. The portion 208' is hinged to a stationary portion 202' of the platform. The end 193 of shelf portion 208' can be releasably attached to cross member 195. This embodiment forms separate collection areas X and Y and has particular use for collecting liquid-type food wastes in area Y, and collecting bottles, cans and other recyclables in area X. Area Y can be emptied first through end wall 192'. Thereafter, shelf portion 208' can be released from cross member 195 so the content of area X can be emptied.

Figure 8:
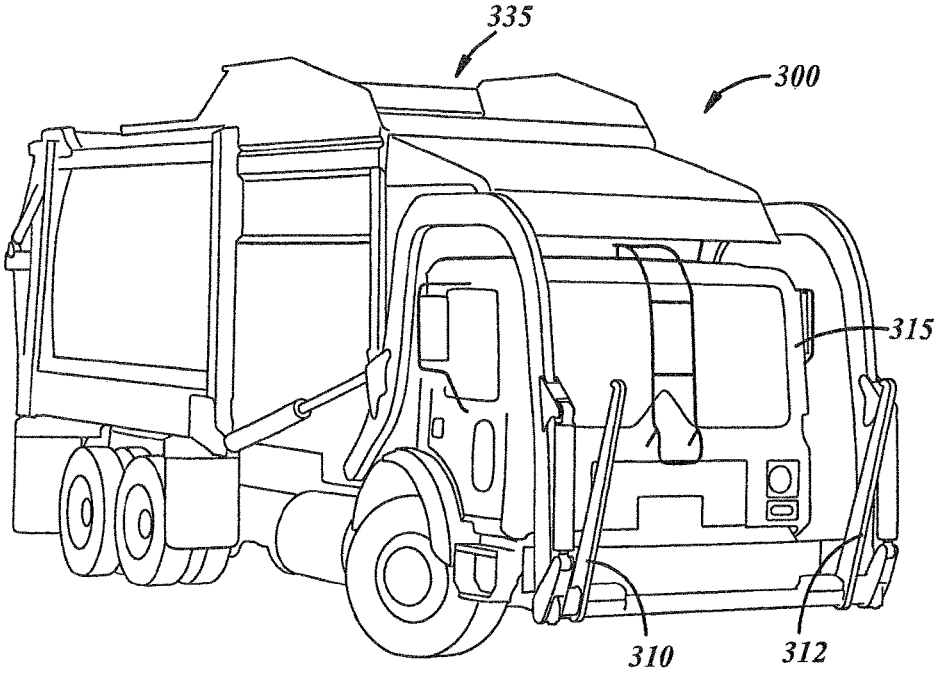
FIG. 8 depicts a perspective view of an exemplary front loading waste collection vehicle.
Figure 9:
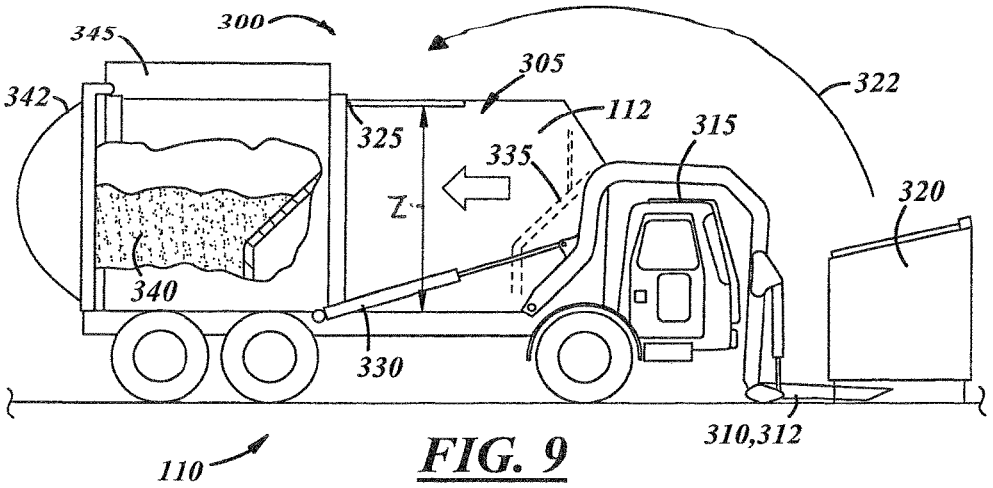
FIG. 9 depicts a side view of the waste collection vehicle in FIG. 8.
Figure 10:
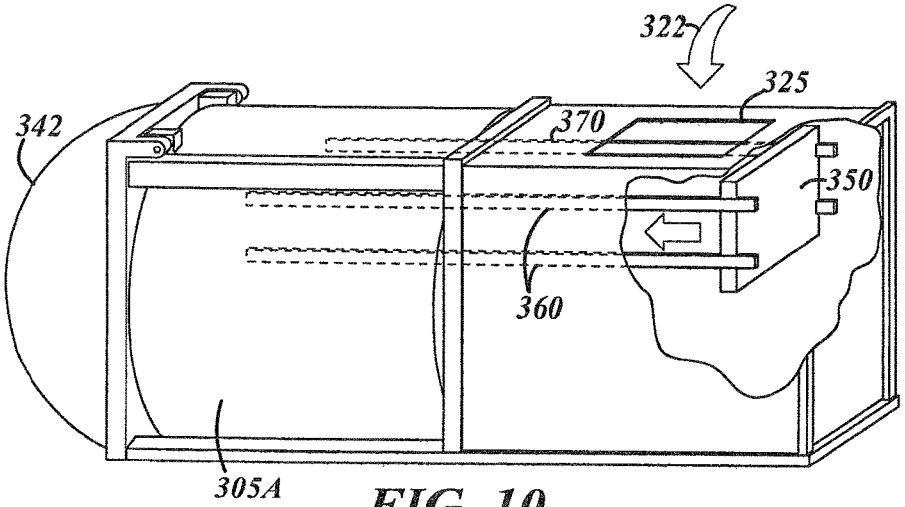
FIGS. 10, 11 and 12 illustrate embodiments of the present invention for use with waste collection vehicles.
Figure 11:
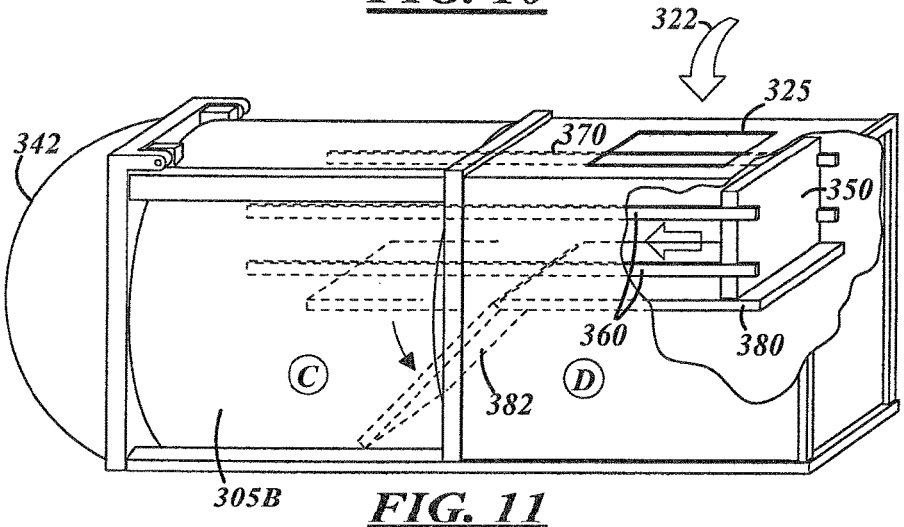
Figure 12:
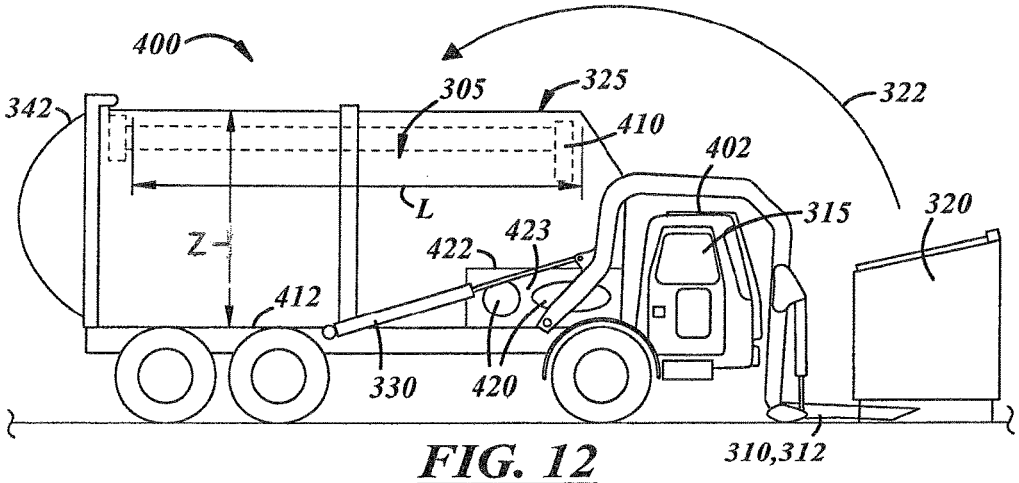

The use of the present invention in waste collection vehicles (a/k/a "garbage trucks") is shown in FIGS. 8-12. FIGS. 8, 9, and 12 illustrate a representative front-loading waste collection truck 300. The vehicle has a truck collection container 305 and a pair of hydraulic actuated lift arms 310, 312 that extend in the front of the cab 315. In use, the lift arms are used to pick up collection container, such as container 320 (typically smaller than the large containers discussed above), and lift them in accordance with the arrow 322 and dump the contents into an opening 325 in the top of the truck container 305. Hydraulic cylinders 330 are used to operate the lift arms.

The waste container 305 is a large collection vessel for compacting, storing, and transporting trash and other waste materials. A compactor blade 335 is positioned inside the container 305 and is hydraulically actuated to push the waste materials 340 in a direction toward the rear of the vehicle and compact the materials against the rear wall 342. The compactor blade is positioned on the floor of the container and extends substantially the entire height "Z" of the container. The rear wall 342 is typically hinged in order to be opened to allow the collected trash materials to be ejected from the container.

The compactor blade 335 is adapted to travel along all or a significant portion of the length of the container and is preferably operated hydraulically. The hydraulic systems can be positioned at any convenient location on the vehicle. The engines for waste collection vehicles are typically diesel engines or engines that run on compressed natural gas (CNG). In CNG driven vehicles, the CNG tanks and systems are typically positioned in a compartment 345 positioned at the top of the vehicle adjacent the rear end. The positioning of the CNG components in a compartment, such as a compartment 345, on the top of the vehicle can cause problems during use of the vehicle for its purpose. The added height caused often causes unintentional damage to the compartment or system from obstacles such as low ceilings, trees, and other obstructions.

It is to be understood that the present invention is not to be limited to the use of hydraulic systems to move the compactor blade and compact the waste materials. Other systems could be used for this purpose.

FIGS. 10 and 11 schematically depict waste containers 305A and 305B for a waste collection vehicle, such as a front loading waste collection truck depicted in FIGS. 8 and 9. In use of the present invention in the containers in FIGS. 10 and 11, a compactor blade 350 is positioned inside the containers and raised above the floor, and positioned, guided and used in a similar manner to the compactor blades 75, 75A, 75B, 204 and 204' discussed above with respect to FIGS. 2-4 and 6-7. A carriage system could also be used to guide the blade inside the vehicle's container. The compactor blades 350 are actuated by a hydraulic system in a similar push or pull manner discussed above and the blade is guided by guide rails such as 360 or 370 on the side walls or top wall of the containers 305A, 305B, again in the same manner as discussed above. The manner of use and results achieved thereby of the invention in the containers is the same as the use and results discussed above with respect to the other embodiments of the invention.

The embodiment of the invention shown in FIG. 11 is similar to the embodiment discussed above with respect to FIGS. 6A-6B. The vehicle waste collection container 305B has a platform 380 which is positioned below the blade 350. The hinged portion 382 of the platform can be used to divide the inside of the container into two separate compartments C and D. In this manner, one collection truck can be used in a neighborhood to collect both waste materials and recyclables.

Again, when it is desired to empty the two compartments, the compartments are typically emptied separately. First, the materials in compartment C are emptied. Then, the hinged portion 382 is raised and the materials in compartment D are emptied. The trash collection containers are typically elevated like dump trucks in order to dump or unload the waste materials. The compaction blade can also be used to help eject the materials. Other systems could also be used to empty out the contents of a container, such as systems utilizing a manually operated "walking floor" apparatus.

An improvement in the location of CNG systems to operate a waste collection vehicle is possible with the present inventive raised compactor blade system. This is shown in FIG. 12 and indicated generally by the reference numeral 400. Components which are the same as the vehicle disclosed relative to FIG. 9 are indicated by the same reference numerals. The compactor blade 410 is positioned raised above the floor 412. The collection container 305 has a height "Z" and length "L". Waste materials poured into the top opening 325 of the container are redistributed, densified, and compacted by the blade 410 as it travels back and forth along the length L in the container.

The floor 412 of the collection container 305 has a raised floor 422 positioned below the compactor blade and in the front of the container near the cab. The CNG cylinders and equipment 420 are positioned under the waste container formed by the raised floor 422. By positioning the CNG equipment under the waste container, rather than on top of the waste container, this prevents them from being damaged or interfering with the movement of the vehicle.

In order to show the benefits and advantages of the present invention, comparison tests were made with representative scale models. The tests compared the payloads and weight of containers which were loaded with similar materials and which used the following three types of compaction blades: (1) a full blade; (2) a partial blade on the floor; and (3) a raised partial blade.

A one inch-per-foot model was constructed to reflect the mobile and stationary compactor applications. The conventional mobile and box-like compactor containers are normally 22 feet in length, 8 feet in height, and 8 feet in width. The scale model chamber was correspondingly made to be 22"×8"×8". The model had a wood box-type frame with an open space for loading materials at the upper end of the chamber adjacent the compactor blade.

The travel of the compaction blade was powered by an electric scissor-action device commonly used to power an automobile window. The electric motor was energized by a 12-volt automotive battery. A 12-volt battery charger was continuously utilized to maintain a constant charge in the battery.

The blades were all made of wood and attached to an elongated rod. Guide rails were used along the edge of the floor for blades (1) and (2). Mulch was used as the compaction material. The mulch was added to the containers during the tests in measured one liter units. The mulch was added and compacted in all of the tests in the same manner.

The model compaction chamber was placed on a digital scale in order to record the weight tests. The chamber was weighed before and after each test. Each test was run several times.

Full Blade Test: The blade was 7½"×7½" and was connected to the elongated rod. The model was operated several times without anything in the chamber to make sure that the blade traveled smoothly from one end to the other. The mulch was added in measured units through the opening in the top surface. The blade was activated and the mulch compacted after each unit of mulch was loaded into the chamber.

Floor Blade Test: The blade was 4" in height and 7½" in width. The blade rested on and traveled along the floor. It was guided by guide rails positioned at the bottom corner of each of the side walls.

Raised Blade Test: This test incorporated the invention. The blade was 3" in height and 7½" in width. The top edge of the blade was positioned immediately adjacent the top wall and the bottom edge of the blade was spaced about 5" from the floor of the chamber. The movement of the blade along the chamber was guided by guide rails positioned on the upper edges of the side walls adjacent the top wall.

Test Results: The mulch was added in the same liter units during each test, and the compaction blade operated and the material compacted in the same manner until it was not possible to add any additional mulch. The number of measured units of mulch was recorded for each of the four tests for each type of blade, and the four amounts averaged. The weight of the compactor chambers was also taken after each test and the amounts were averaged. The results are shown in the following chart:

| | Units Added | Average Units Added | Weight | Average Full Weights |
|---|---|---|---|---|
| Full Blade | 19.5, 18, 18, 18 | 18.38 | 5.3, 4.4, 4.8, 3.8 | 4.76 |
| Floor Blade | 13, 13, 13, 13 | 13 | 4.4, 4.2, 4.4, 4.4 | 4.35 |
| Raised Blade | 22.5, 22, 23, 20.5 | 22 | 6.9, 7.1, 7.3, 7.1 | 7.1 |

As evidenced, the model representing the present invention was able to compact 20% more of the waste materials than the full blade embodiment and 69% more than the floor blade embodiment. In addition, the average weight of the compacted loads was 49% and 63% greater with the partial (raised) blade than the full blade and floor blade embodiments, respectfully.

The results of these tests showed that the present invention with use of a raised compactor blade resulted in filling the waste containers with 20% to 69% more of the waste materials and a load which was 49% to 63% heavier. Thus, the use of the present invention would result in substantial savings of time, money and labor in the collection of waste materials.

Although the invention has been described with respect to preferred embodiments, it is to be also understood that it is not to be so limited since changes and modifications can be made therein which are within the full scope of this invention as detailed by the following claims.

What is claimed is:

1. A compacting waste container comprising:

a container having a front wall, a back wall, two sidewalls, a top wall and a bottom wall, said top wall having at least one opening therein for entry of waste materials;

said front wall, back wall, sidewalls, top wall and bottom wall forming a single cavity for collection of said waste material;

said single cavity having a cavity height H between said bottom wall and said top wall;

a compactor blade positioned in said single cavity said compactor blade having an upper edge, a lower edge, a front face extending between said edges and facing said front wall of said container, and a rear face extending between said edges and facing said back wall of said container;

said compactor blade spaced vertically from said bottom wall and adapted to compact waste materials located between said compactor blade and said bottom wall;

said compactor blade being linearly reciprocal longitudinally in said single cavity and said front face of said blade adapted to compact waste materials during linear movement in one direction towards said front wall of said container and said rear face of said blade adapted to compact waste materials during linear movement in an opposite direction towards said back wall of said container;

guide members for said compactor blade on both sidewalls;

said compactor blade positioned adjacent the top wall and having a blade height extending between said upper and lower edges in the range of 30-70% of said cavity height H; and a mechanism for moving said compactor blade longitudinally in said single cavity in said container.

2. The compacting waste container as described in claim 1 wherein the blade height of said compactor blade is 50% of said cavity height H.

3. The compacting waste container as described in claim 1 further comprising means on said compactor blade for mating with said guide members for assisting movement of said compactor blade longitudinally in said container.

4. The compacting waste container as described in claim 1 wherein the blade height of the compactor blade is 30% of said cavity height H.

5. The compacting waste container as described in claim 1 wherein a substantial portion of said mechanism is positioned internally in said container.

6. The compacting waste container as described in claim 1 wherein said mechanism is a hydraulic system.

7. The compacting waste container as described in claim 1 further comprising guide rail members on said top wall for assisting movement of said compactor blade in said container.

8. The compacting waste container as described in claim 1 further comprising claw members positioned on the bottom edge of said compactor blade.

9. The compacting waste container as described in claim 8 wherein said claw members are rotatably attached to said compactor blade.

10. The compacting waste container as described in claim 1 further comprising a platform member positioned in said container between said top wall and said bottom wall and extending between said two sidewalls.

11. The compacting waste container as described in claim 10 wherein said platform member is positioned adjacent the lower edge of said compactor blade.

12. The compacting waste container as described in claim 10 wherein said platform has a first fixed portion and a second hinged portion.

13. The compacting waste container as described in claim 12 wherein said hinged portion can be rotated relative to said fixed position in order to divide the interior of said container into two separate compartments.

14. The compacting waste container as described in claim 12 wherein said hinged portion can be selectively positioned substantially co-planar with said fixed portion.

15. The compacting waste container as described in claim 1 wherein mechanism is a hydraulic actuation mechanism, and includes at least one hydraulic cylinder and an operating system, and at least part of said operating system is positioned in a compartment in the interior of said container.

16. The compacting waste container as described in claim 15 wherein said compartment is positioned on said bottom wall adjacent said back wall.

17. The compacting waste container as described in claim 12 wherein said upper edge of said compactor blade is spaced a distance about 20%-30% from said top wall.

18. The compacting waste container as described in claim 10 wherein at least a portion of said platform is angled vertically upwardly toward said front wall in said container.

19. The compacting waste container as described in claim 1 wherein said guide members comprise pairs of spaced apart rail members.

20. The compacting waste container as described in claim 19 wherein the distance between said pair of spaced apart rail members allows said compactor blade to float between them.

21. The compacting waste container as described in claim 2 wherein said top wall has a first portion and a second portion, and wherein said first portion is positioned 20%-30% below the height of said second portion.

22. The compacting waste container as described in claim 21 wherein said opening for entry of waste materials is positioned in said first portion.

23. The compacting waste container as described in claim 21 wherein said upper edge of said compactor blade is spaced correspondingly 20%-30% below the height of said second portion.

24. A compacting waste container comprising:

a container having a front wall, a back wall, two sidewalls, a top wall and a bottom wall, said top wall having at least one opening therein for entry of waste materials;

said container having a height H between said bottom wall and said top wall;

a compactor blade positioned in said container, said compactor blade positioned adjacent the top wall and having a height in the range of 30-70% of said height H;

a mechanism for linearly reciprocating said compactor blade longitudinally in said container; and a platform member positioned in said container between said top wall and said bottom wall and extending substantially between said two sidewalls, said platform having a first fixed portion and a second hinged portion.

25. The compacting waste container as described in claim 24 wherein said hinged portion can be rotated relative to said fixed position in order to divide the interior of said container into two separate compartments.

26. The compacting waste container as described in claim 24 wherein said hinged portion can be selectively positioned substantially co-planar with said fixed portion.

27. The compacting waste container as described in claim 24 wherein said mechanism includes at least one hydraulic cylinder and an operating system, and at least part of said operating system is positioned in a compartment in the interior of said container.

28. The compacting waste container as described in claim 24 wherein said compactor blade has an upper edge and said upper edge is spaced a distance about 20%-30% from said top wall.

29. The compacting waste container as described in claim 24 wherein said platform is positioned adjacent a lower edge of said compactor blade wherein said compactor blade can pass by said platform.

30. A collection container for waste materials comprising:

a container having a front wall, a back wall, sidewalls, a top wall and a bottom wall, said front, back, side, top and bottom walls forming a collection cavity for waste materials;

said collection cavity having a height H between said bottom wall and said top wall;

a blade member positioned in said collection cavity;

said blade member spaced vertically from said bottom wall and adapted to compact materials located between said blade member and said bottom wall;

said blade member having an upper edge, a lower edge, a front face extending between said edges and facing said front wall of said container, and a rear face extending between said edges and facing said back wall of said container;

said blade member being linearly reciprocal longitudinally in said single cavity and adapted to compact waste materials during linear movement in one direction with one of said front or rear faces and during linear movement in an opposite direction with the other of said front or rear faces;

said blade member positioned adjacent the top wall and having a height in the range of 30-70% of said height H; and a mechanism for moving said blade member longitudinally in said collection cavity.

31. The collection container as described in claim 30 wherein the height of said blade member is substantially 50% of said height H.

32. The collection container as described in claim 30 wherein said collection container is a waste material collection and compacting container, and said blade member is a compactor blade member.

33. The collection container as described in claim 32 wherein said mechanism for moving said blade member comprises a hydraulic actuation mechanism.

34. The collection container as described in claim 30 further comprising guide rail members on two sidewalls for assisting movement of said blade member in said collection cavity.

35. The compacting waste container as described in claim 30 wherein said mechanism for moving said blade member is a hydraulic actuation mechanism.

36. A compacting and collection container for waste and other materials comprising:

a container comprising a plurality of wall members forming a single collection cavity;

said plurality of wall members including at least a top wall member, a bottom wall member, a front wall member, and a rear wall member;

said wall members having at least one opening in said top wall member for entry of waste and other materials;

said cavity having a height H between said bottom wall and said top wall;

a compactor blade member positioned in said single cavity and being movable back and forth longitudinally therein;

said compactor blade member spaced vertically from said bottom wall and adapted to compact waste and other material located between said compactor blade member and said bottom wall;

said compactor blade member having an upper edge, a lower edge, a front face extending between said edges and facing said front wall member of said container, and a rear face extending between said edges and facing said rear wall member of said container;

a platform member positioned in said cavity in vertical alignment with said opening in said top wall member and adjacent the lower edge of said compactor blade member;

said compactor blade member adapted to move longitudinally in a first longitudinal direction for displacing materials on said platform onto said bottom wall member with one of said front or rear faces of said compactor blade member;

said compactor blade member adapted to move longitudinally in a second longitudinal direction for displacing materials on said platform onto said bottom wall member with the other of said front or rear faces of said compactor blade member;

said compactor blade member positioned adjacent said top wall and having a height in the range of 30-70% of said height H; and a mechanism for linearly reciprocating said compactor blade member longitudinally in said first and second directions in said cavity.

37. The compacting and collection container as described in claim 36 wherein said mechanism for moving said compactor blade member is a hydraulic actuation mechanism.

38. The compacting and collecting container as described in claim 36 further comprising at least one guide rail member positioned on at least one of said plurality of wall members for assisting movement of said compactor blade member in said unitary cavity.

39. The compacting and collection container as described in claim 38 wherein said guide rail members comprise a first guide rail member on a first wall member and a second guide rail member positioned on a second wall member.

40. The compacting and collection container as described in claim 39 wherein said opening is positioned relative to said platform member to allow materials entering said unitary cavity to contact said platform member, and said compactor blade member being longitudinally moveable bi-directionally, wherein materials introduced into said unitary cavity can be separated into different areas of said cavity.

41. A compacting container for waste and other materials comprising:

a container forming a cavity for collection of waste and other materials and having at least a top wall portion, a bottom wall portion, a front wall portion, a rear wall portion, and two side wall members, said cavity having at least one opening therein for entry of materials;

said cavity having a height H at least at one position between said bottom wall portion and said top wall portion;

a compactor blade member positioned in said container and having an upper edge, a lower edge, a front face extending between said edges and facing said front wall portion of said container, and a rear face extending between said edges and facing said rear wall portion of said container;

said compactor blade linearly reciprocal longitudinally and bi-directionally in said cavity for compacting waste and other materials in one direction with one of said front or rear faces and in an opposite direction with the other of said front or rear faces;

said compactor blade member spaced vertically from said bottom wall portion and adapted to compact waste and other materials located between said compactor blade member and said bottom wall portion;

said compactor blade member positioned adjacent said top wall portion and having a height in the range of 30-70% of said height H.

42. A system comprising the compacting container set forth in claim 41 and a hydraulic actuation mechanism for moving said compactor blade member in said cavity for compacting waste and other materials positioned in said cavity.

43. The system as set forth in claim 41 further comprising first guide members on said two sidewall members for assisting longitudinal movement of said compactor blade in said cavity.

44. The system as set forth in claim 43 further comprising second guide members on said compactor blade for mating with said first guide member.

45. A compacting waste container comprising:

a container having a front wall, a back wall, two sidewalls, a top wall and a bottom wall, said top wall having at least one opening therein for entry of waste materials;

said front wall, back wall, sidewalls, top wall and bottom wall forming a single cavity for collection of said waste material;

said single cavity having a cavity height H between said bottom wall and said top wall;

a compactor blade positioned in said single cavity said compactor blade having an upper edge, a lower edge, a front face extending between said edges and facing said front wall of said container, and a rear face extending between said edges and facing said back wall of said container;

said compactor blade being linearly reciprocal longitudinally in said single cavity and said front face of said blade adapted to compact waste materials during linear movement in one direction towards said front wall of said container and said rear face of said blade adapted to compact waste materials during linear movement in an opposite direction towards said back wall of said container;

said compactor blade spaced vertically from said bottom wall and adapted to compact waste materials located between said compactor blade and said bottom wall;

said compactor blade positioned adjacent the top wall and having a blade height extending between said upper and lower edges the in the range of 30-70% of said cavity height H;

a mechanism for moving said compactor blade longitudinally in said single cavity in said container; and guide members extending along a respective one of said sidewalls for guiding said compactor blade during the longitudinal movement within said single cavity.

* * * * *